US006540022B2

(12) United States Patent
Dusterhoft et al.

(10) Patent No.: US 6,540,022 B2
(45) Date of Patent: Apr. 1, 2003

(54) METHOD AND APPARATUS FOR FRAC/ GRAVEL PACKS

(75) Inventors: Ronald Glen Dusterhoft, Katy, TX (US); Travis Thomas Hailey, Jr., Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/079,448

(22) Filed: Feb. 19, 2002

(65) Prior Publication Data

US 2002/0104650 A1 Aug. 8, 2002

Related U.S. Application Data

(60) Division of application No. 09/520,305, filed on Mar. 7, 2000, which is a continuation-in-part of application No. 09/399,674, filed on Sep. 21, 1999, now Pat. No. 6,427,775, which is a continuation-in-part of application No. 09/361,714, filed on Jul. 27, 1999, now Pat. No. 6,446,722, which is a continuation-in-part of application No. 09/084,906, filed on May 26, 1998, now Pat. No. 5,934,376, which is a continuation-in-part of application No. 08/951,936, filed on Oct. 16, 1997, now Pat. No. 6,003,600.

(51) Int. Cl.[7] ..... E21B 43/04
(52) U.S. Cl. ..... 166/278; 166/236
(58) Field of Search ..... 166/276, 278, 166/280, 308, 227, 236

(56) References Cited

U.S. PATENT DOCUMENTS

| | | | |
|---|---|---|---|
| 1,305,915 | A | 6/1919 | Mack |
| 1,341,755 | A | 6/1920 | Minton |
| 2,207,334 | A | 7/1940 | Reynolds et al. |
| 2,342,913 | A | 2/1944 | Williams et al. |

(List continued on next page.)

FOREIGN PATENT DOCUMENTS

| | | | |
|---|---|---|---|
| EP | 0909874 | 4/1999 | ..... E21B/43/02 |
| EP | 0909875 | 4/1999 | ..... E21B/43/04 |
| GB | 2316967 | 3/1998 | ..... E21B/43/26 |
| GB | 2317630 | 4/1998 | ..... E21B/43/08 |
| WO | 0421822 | 5/1990 | ..... E21B/37/08 |
| WO | WO9304267 | 3/1993 | ..... E21B/43/25 |
| WO | WO9322536 | 11/1993 | ..... E21B/43/04 |
| WO | WO9416194 | 7/1994 | ..... E21B/43/04 |
| WO | WO9514844 | 6/1995 | ..... E21B/43/04 |
| WO | WO9533915 | 12/1995 | ..... E21B/43/267 |
| WO | WO0061913 | 10/2000 | ..... E21B/43/04 |
| WO | WO0114691 | 3/2001 | ..... E21B/43/08 |
| WO | WO0144619 | 6/2001 | ..... E21B/43/04 |

OTHER PUBLICATIONS

Schlumberger Dowell; *Alternate Path+Services*, Feb. 1997; (p. 9).

L. Jones; Petroleum Engineer International; *Fracpacking Horizontal Wells Allows Ultra–High Rates From Mediocre Formation*; Jul. 1999; (pp. 37–40).

*Primary Examiner*—David Bagnell
*Assistant Examiner*—John Kreck
(74) *Attorney, Agent, or Firm*—Michael W. Piper

(57) ABSTRACT

A method for fracturing a formation or gravel packing a borehole using a screen assembly having a plurality of screens mounted on a base member and a plurality of apertures disposed at predetermined intervals along the screen assembly. A flow-control service assembly is disposed within the screen assembly and includes an outer tubular member and an inner tubular member. The outer tubular member includes a plurality of ports that communicate with the apertures in the screen assembly. Barriers are placed around the ports on the outer tubular member to prevent the formation of gravel bridges across the inner annulus between the inner tubular member and outer tubular member. The inner annulus provides alternative flow paths around the ports upon the ports becoming closed to fluid flow such as by bridges.

14 Claims, 9 Drawing Sheets

U.S. PATENT DOCUMENTS

| | | | | | |
|---|---|---|---|---|---|
| 2,344,909 | A | | 3/1944 | Williams et al. | |
| 3,670,817 | A | | 6/1972 | Saucier | 166/252 |
| 4,042,032 | A | | 8/1977 | Anderson et al. | 166/276 |
| 4,070,865 | A | | 1/1978 | McLaughlin | 61/36 |
| 4,102,395 | A | | 7/1978 | Robinson | 166/231 |
| 4,428,426 | A | | 1/1984 | Davies et al. | 166/276 |
| 4,428,436 | A | | 1/1984 | Johnson | 172/372 |
| 4,474,239 | A | | 10/1984 | Colomb et al. | 166/278 |
| 4,829,100 | A | | 5/1989 | Murphey et al. | 523/131 |
| 4,858,691 | A | * | 8/1989 | Ilfrey et al. | 166/230 |
| 4,945,991 | A | | 8/1990 | Jones | 166/278 |
| 5,058,676 | A | | 10/1991 | Fitzpatrick et al. | 166/278 |
| 5,082,052 | A | | 1/1992 | Jones et al. | 166/51 |
| 5,113,935 | A | | 5/1992 | Jones et al. | 166/51 |
| 5,128,390 | A | | 7/1992 | Murphey et al. | 523/130 |
| 5,161,613 | A | | 11/1992 | Jones | 166/242 |
| 5,161,618 | A | | 11/1992 | Jones et al. | 166/308 |
| 5,165,476 | A | * | 11/1992 | Jones | 166/227 |
| 5,333,688 | A | | 8/1994 | Jones et al. | 166/278 |
| 5,341,880 | A | | 8/1994 | Thorstensen et al. | 166/278 |
| 5,417,284 | A | | 5/1995 | Jones | 166/280 |
| 5,419,394 | A | | 5/1995 | Jones | 166/51 |
| 5,435,391 | A | | 7/1995 | Jones | 166/308 |
| 5,476,143 | A | | 12/1995 | Sparlin et al. | 166/233 |
| 5,515,915 | A | | 5/1996 | Jones et al. | 166/51 |
| 5,560,427 | A | | 10/1996 | Jones | 166/280 |
| 5,588,487 | A | | 12/1996 | Bryant | 166/51 |
| 5,597,040 | A | | 1/1997 | Stout et al. | 166/51 |
| 5,609,207 | A | | 3/1997 | Dewprashad et al. | 166/276 |
| 5,669,445 | A | | 9/1997 | Edwards | 166/278 |
| 5,890,533 | A | | 4/1999 | Jones | 166/51 |
| 5,921,318 | A | | 7/1999 | Ross | 166/250.17 |
| 5,934,376 | A | | 8/1999 | Nguyen et al. | 166/278 |
| 6,003,600 | A | | 12/1999 | Nguyen et al. | 166/281 |
| 6,059,032 | A | * | 5/2000 | Jones | 166/157 |
| 6,220,345 | B1 | | 4/2001 | Jones et al. | 166/51 |

* cited by examiner

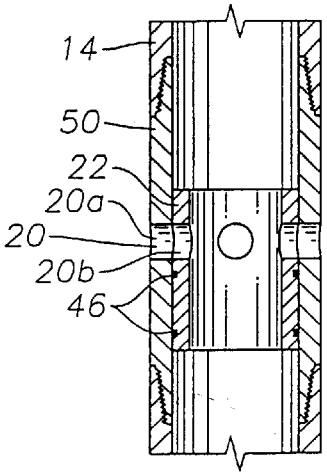
Fig. 4A
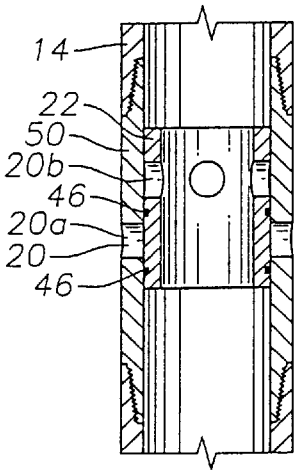
Fig. 4B
Fig. 5
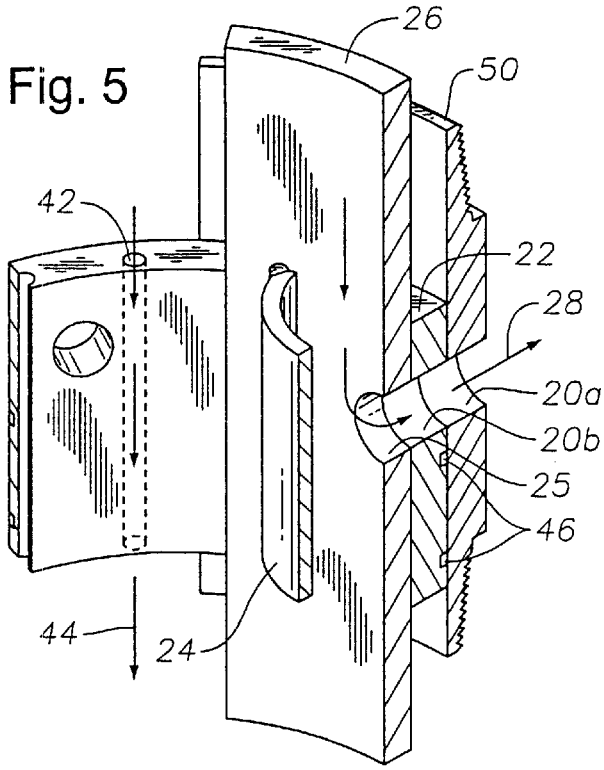
Fig. 6
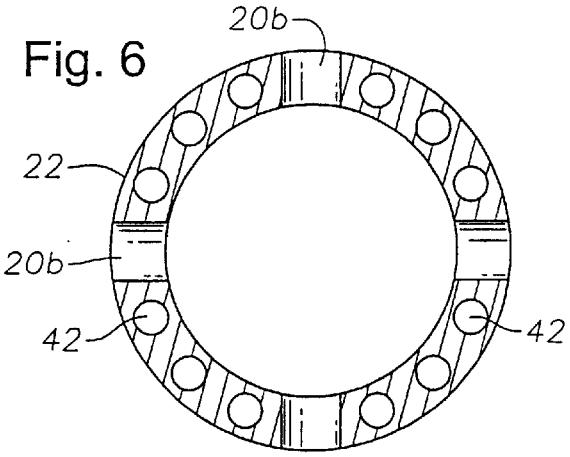
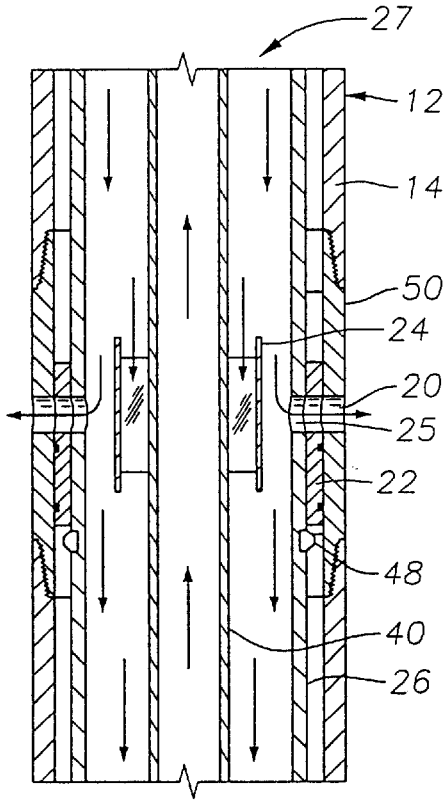
Fig. 7

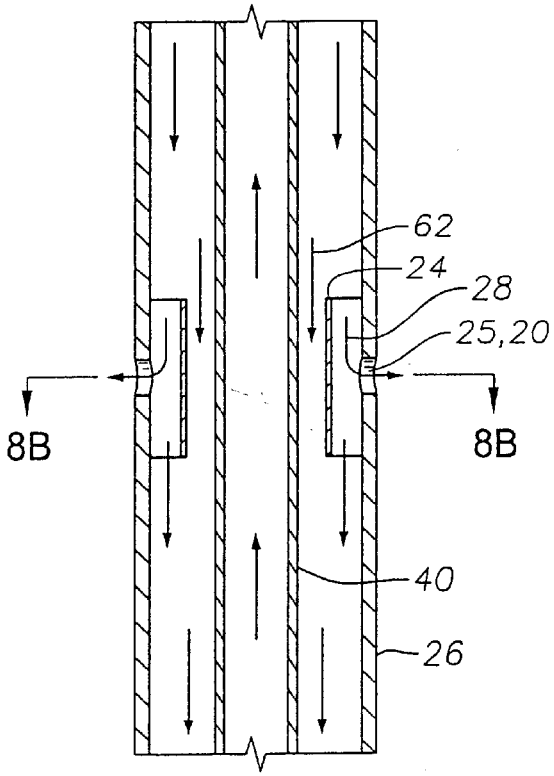
Fig. 8A
Fig. 8B
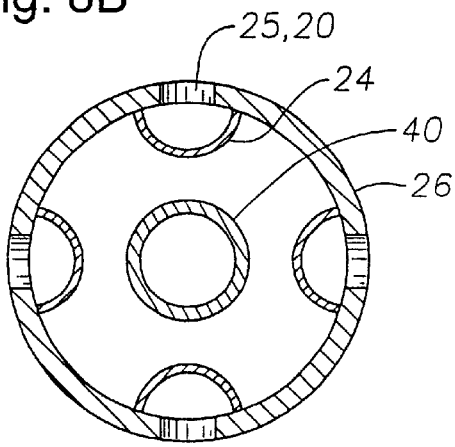
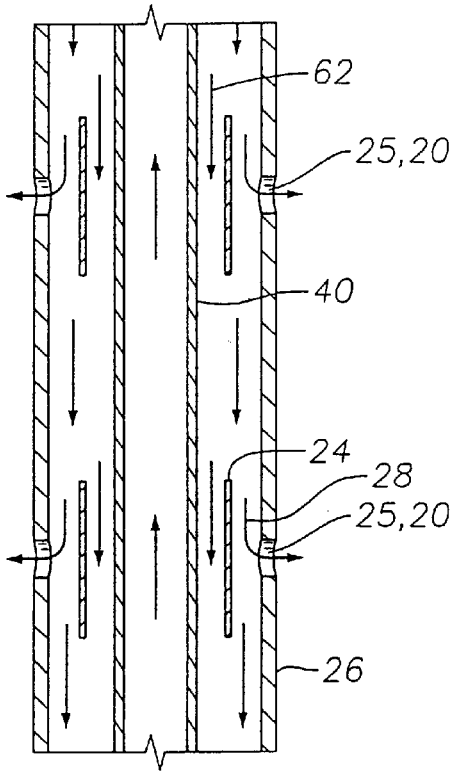
Fig. 9A
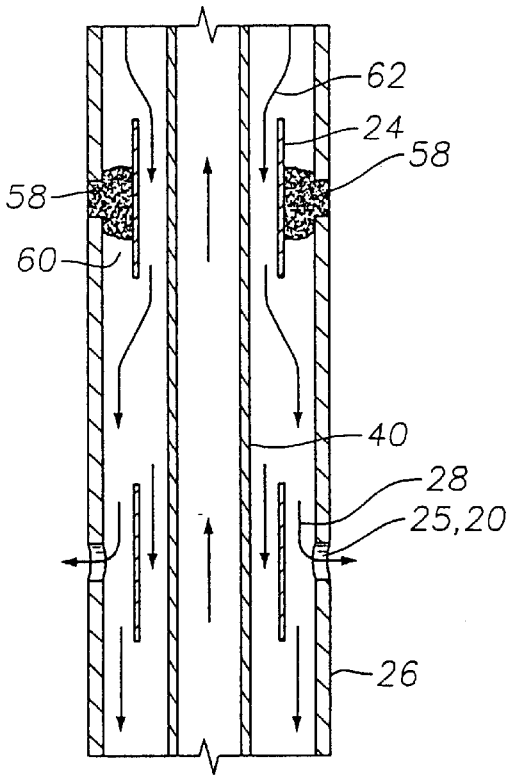
Fig. 9B

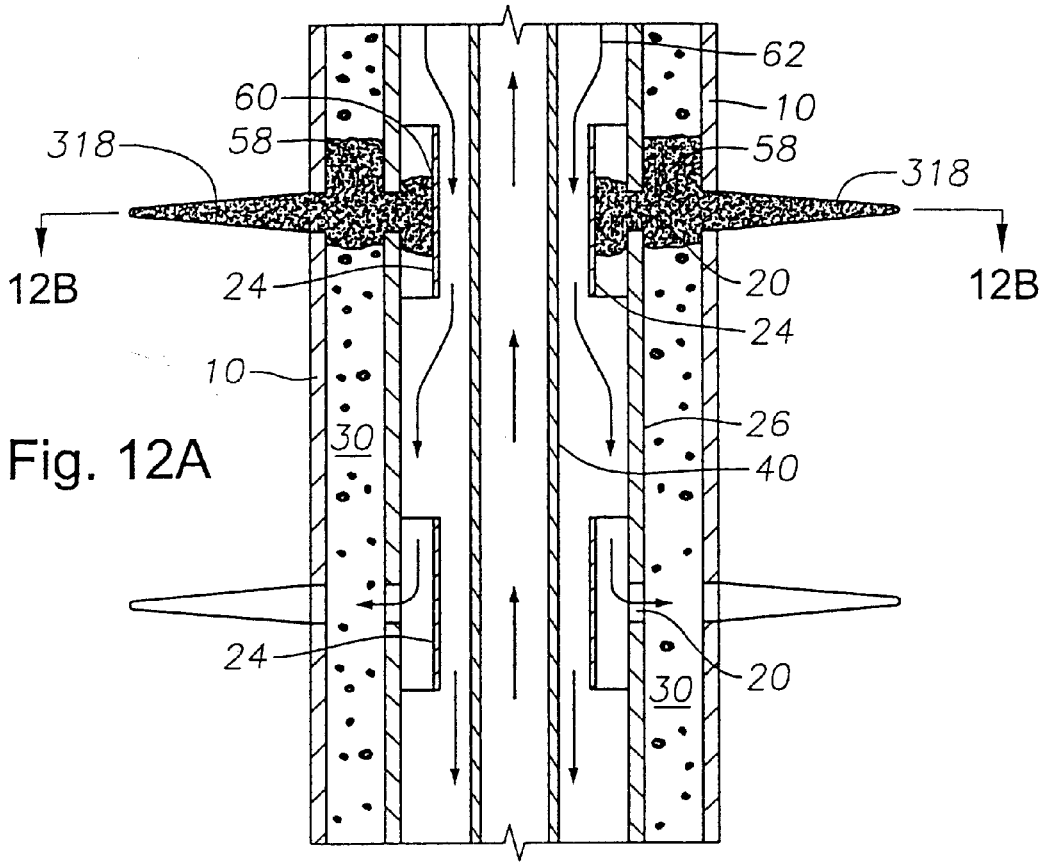
Fig. 12A
Fig. 12B
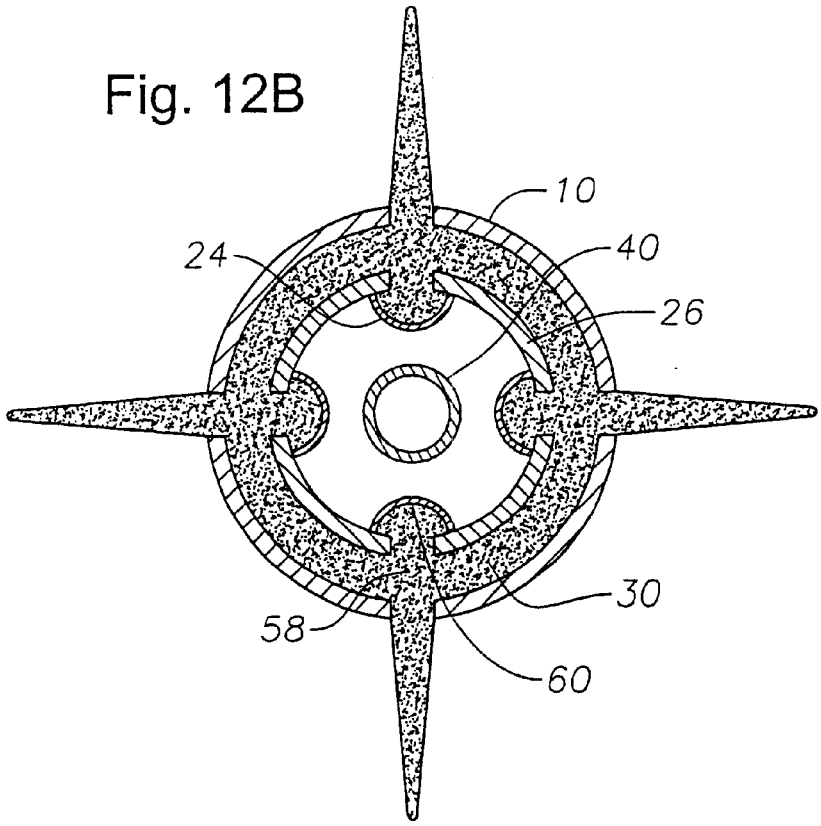

METHOD AND APPARATUS FOR FRAC/ GRAVEL PACKS

CROSS-REFERENCE TO RELATED APPLICATIONS

This is a divisional application of co-pending U.S. patent application Ser. No. 09/520,305, filed Mar. 7, 2000, hereby incorporated by reference in its entirety.

This application is a continuation-in-part of application Ser. No. 09/399,674 filed on Sep. 21, 1999, now U.S. Pat. No. 6,427,775, which is a continuation-in-part of application Ser. No. 09/361,714 filed on Jul. 27, 1999, now U.S. Pat. No. 6,446,722, which is a continuation-in-part of application Ser. No. 09/084,906 filed on May 26, 1998, now U.S. Pat. No. 5,934,376, which is a continuation-in-part of application Ser. No. 08/951,936 filed on Oct. 16, 1997, now U. S. Pat. No. 6,003,600, all hereby incorporated herein by reference.

STATEMENT REGARDING FEDERALLY SPONSORED RESEARCH OR DEVELOPMENT

Not Applicable.

FIELD OF THE INVENTION

The present invention relates to improved methods and apparatus for completing wells in unconsolidated subterranean zones. More particularly, the present invention relates to improved methods and apparatus for achieving effective frac treatments and uniform gravel packs in completing such wells. Still more particularly, the present, invention relates to improved methods for achieving effective frac treatments and uniform gravel packs over long and/or deviated production intervals and maximizing the internal production area of the screen assembly by removing an inner flow-control service assembly after treatment.

BACKGROUND OF THE INVENTION

Oil and gas wells are often completed in unconsolidated formations containing loose and incompetent fines and sand that migrate with fluids produced by the wells. The presence of formation fines and sand in the produced fluids is disadvantageous and undesirable in that the particles abrade and damage pumping and other producing equipment and reduce the fluid production capabilities of the producing zones in the wells.

Completing unconsolidated subterranean zones typically comprises a frac treatment and a gravel pack. A frac/gravel pack apparatus, which includes a sand screen assembly and the like, is commonly installed in the wellbore penetrating the unconsolidated zone. During frac treatment, the zone is stimulated by creating fractures in the rock and depositing particulate material, typically graded sand or man-made proppant material, in the fractures to maintain them in open positions. Then the gravel pack operation commences to fill the annular area between the screen assembly and the wellbore with specially sized particulate material, typically graded sand or man-made proppant. The particulate material creates a barrier around the screen and serves as a filter to help assure formation fines and sand do not migrate with produced fluids into the wellbore. Preferably, to simplify operations, the frac treatment particulate material is the same as the gravel packing particulate material. However, as described herein, the term "proppant" refers to the frac treatment particulate material and the term "gravel" refers to the gravel packing particulate material.

In a typical frac/gravel pack completion, a screen assembly is placed in the wellbore and positioned within the unconsolidated subterranean zone to be completed. As shown in FIG. 1, a screen assembly 130 and a wash pipe 140 are typically connected to a tool 100 that includes a production packer 120 and a cross-over 110. The tool 100 is in turn connected to a work or production string 190 extending from the surface, which lowers tool 100 into the wellbore until screen assembly 130 is properly positioned adjacent the unconsolidated subterranean zone to be completed.

To begin the completion, the interval adjacent the zone is first isolated. The bottom of the well 195 typically isolates the lower end of the interval or alternatively a packer can seal the lower end of the interval if the zone is higher up in the well. The production packer 120 typically seals the upper end of the interval or alternatively the wellhead may isolate the upper end of the interval if the zone is located adjacent the top of the well. The cross-over 110 is located at the top of the screen assembly 130, and during frac treatment a frac fluid, such as viscous gel, for example, is first pumped down the production string 190, into tool 100 and through the cross-over 110 along path 160. The frac fluid passes through cross-over ports 115 below the production packer 120, flowing from the flowbore of production string 190 and into the annular area or annulus 135 between the screen assembly 130 and the casing 180.

Initially the assembly is in the "squeeze" position where no fluids return to the surface. In the squeeze position, valve 113 at the top of the wash pipe is closed so fluids cannot flow through wash pipe 140. During squeeze, the frac fluid, typically viscous gel mixed with proppant, is forced through perforations 150 extending through the casing 180 and into the formation. The frac fluid tends to fracture or part the rock to form open void spaces in the formation. As more rock is fractured, the void space surface area increases in the formation. The larger the void space surface area, the more the carrier liquid in the frac fluid leaks off into the formation until an equilibrium is reached where the amount of fluid introduced into the formation approximates the amount of fluid leaking off into the rock, whereby the fracture stops propagating. If equilibrium is not reached, fracture propagation can also be stopped as proppant reaches the tip of the fracture. This is commonly referred to as a tip screen out design. Next a slurry of proppant material is pumped into the annulus 135 and injected into the formation through perforations 150 to maintain the voids in an open position for production.

In a frac treatment, the goal is to fracture the entire interval uniformly from top to bottom. However, because cross-over 110 introduces frac fluid at the top of the formation interval through ports 115 at a very high flow rate, friction causes a large pressure drop as the frac fluid flows down annulus 135 to reach the bottom 195 of the interval. Therefore, more pressure is exerted on the upper extent of the formation interval than on the lower extent of the interval so that potentially full fracturing occurs adjacent the top of the production zone while reduced or no fracturing occurs. adjacent the bottom. Additionally, formation strength tends to increase at greater depths such that the longer the zone or interval, the greater the strength gradient between the rock at the top and bottom. Because higher fluid pressures are exerted on the weaker rock at the top, and lower fluid pressures are exerted on the stronger rock at the bottom, the strength gradient adds to the concern that only the upper extent of the interval is being fully fractured. To resolve these problems and achieve more uniform fracturing, it would be advantageous to have a frac apparatus capable of injecting frac fluid into the formation at fairly uniform pressures along the entire interval length from top to bottom.

It would also be advantageous to have a frac apparatus capable of continuing to apply frac pressure to the lower extent of the formation even when fractures in the upper interval reach a "tip screen out" condition and therefore stop accepting frac fluids or do so at a reduced rate.

Once the frac treatment is complete, the gravel pack commences, or the gravel pack may take place simultaneously with the frac treatment. During gravel pack, the objective is to uniformly fill outer annulus 135 with gravel along the entire interval. Prior to introducing the gravel pack slurry, the assembly is placed in the "circulation" position by opening valve 113 to allow flow through wash pipe 140 back to the surface. The slurry is then introduced into the formation to gravel pack the wellbore. As slurry moves along path 160, out cross-over paths 115 and into annulus 135, the fluid in the slurry leaks off along path 170 through perforations 150 into the subterranean zone and/or through the screen 130 that is sized to prevent the gravel in the slurry from flowing therethrough. The fluids flowing back through the screen 130, enter the inner annular area or annulus 145 formed between the screen 130 and the inner wash pipe 140, and flow through the lower end of wash pipe 140 up path 185. The return fluids flow out through cross-over port 112 into annulus 105 above the production packer 120 formed between the work string 190 and the casing 180, then back to the surface.

The gravel in the slurry is very uniform in size and has a very high permeability. As the fluid leaks off through the screen 130, the gravel drops out of the slurry and builds up from the formation fractures back toward the wellbore, filling perforations 150 and outer annulus 135 around the screen 130 to form a gravel pack. The size of the gravel in the gravel pack is selected to prevent formation fines and sand from flowing into the wellbore with the produced fluids.

During a gravel-packing operation, the objective is to uniformly pack the gravel along the entire length of the screen assembly 130. Conventional gravel packing using cross-over 110 begins at the bottom 195 of the interval and packs upward. However, with a high leak off of fluid through the perforations 150 and into the formation, the gravel tends to deposit around the perforations 150 thus forming a node. A node is a build up of gravel that grows radially and may grow so large that it forms a bridge and completely blocks the outer annulus 135 between the screen 130 and casing 180. Although the primary flow of the gravel pack slurry begins along the axis of the casing 180, to the extent that the flow becomes radial, gravel nodes will build up and grow radially in the outer annulus 135. When the gravel is packed grain to grain to completely block the outer annulus 135 with gravel, that is commonly termed "screen out" in the industry. Bridging or screen out can occur during gravel packing or during frac treatment when the proppant is injected to maintain the voids in an open position. If formation permeability variations and/or the fracture geometry cause a bridge to form in the annulus around the screen during packing, the gravel slurry will begin packing upward from the bridge. This problem occurs particularly in gravel packs in long and/or deviated unconsolidated producing intervals. The resulting incomplete annular pack has sections of screen that remain uncovered, which can lead to formation sand production, screen erosion and eventual failure of the completion.

FIG. 2 illustrates the problem of the formation of gravel bridges 200 in the outer annulus 135 around the screen 130 resulting in non-uniform gravel packing of annulus 135 between the screen 130 and casing 180. This may occur with conventional frac treatments because fractures in the formation do not grow uniformly, and carrier fluid leaks off into high permeability portions of the subterranean zone 210 thereby causing gravel to fill perforations 250 and form bridges 200 in the annulus 135 before all the gravel has been placed along screen 130. The bridges 200 block further flow of the slurry through the outer annulus 135 leaving voids 220, 230 in annulus 135. When the well is placed on production, the flow of produced fluids may be concentrated through the voids 220, 230 in the gravel pack, soon causing the screen 130 to be eroded by pressurized produced fluids and the migration of formation fines and sand into the production string, thus inhibiting production.

In attempts to prevent voids along the screen 130 in gravel pack completions, special screens having external shunt tubes have been developed and used. See, for example, U.S. Pat. No. 4,945,991. The shunt tubes run externally along the outside of the screen assembly and have holes approximately every 6 feet to inject gravel into the annulus between the screen assembly and the wellbore or casing at each hole location. During a gravel pack completion, if the major flow path is blocked because a bridge develops, a secondary or alternative flow path is available through the shunt tubes. If there are voids along the screen below the bridge, gravel can be injected into the annulus through the shunt tube holes to fill the voids to the top of the interval. The holes are sized to restrict the flow out into the annulus and reduce the rate at which fluid leaks off to bridged portions of the overall interval. When screen out occurs at one hole, the shunt tube itself provides an open flow path for the slurry to proceed to the next hole and begin filling the void in that area. When the gravel is packed above the top perforation in the interval, the pressure goes up dramatically, indicating to the operator that the interval is filly gravel packed.

While shunt-tube screen assemblies have achieved varying degrees of success in achieving uniform gravel packs, they are very costly and remain in the well after gravel packing to become part of the permanent assembly. Because shunt tubes are disposed between the screen assembly and the wellbore wall, the internal diameter of the screen assembly is reduced to accommodate the shunt tubes, thereby limiting the available production area, which is especially undesirable in higher production rate wells. It would be advantageous to have a gravel pack apparatus with alternative flow paths that did not reduce or limit the production area of the screen assembly.

Further improved apparatus and methods of achieving uniform gravel packing are shown in U.S. patent application Ser. No. 09/399,674 filed on Sep. 21, 1999, which is a continuation-in-part of Ser. No. 09/361,714 filed on Jul. 27, 1999, which is a continuation-in-part of application Ser. No. 09/084,906 filed on May 26, 1998, now U.S. Pat. No. 5,934,376, which is a continuation-in-part of application Ser. No. 08/951,936 filed on Oct. 16, 1997, now U.S. Pat. No. 6,003,600, all hereby incorporated herein by reference. See also European patent application EP 0 909 874 A2 published Apr. 21, 1999 and European patent application EP 0 909 875 A2 published Apr. 21, 1999, both hereby incorporated herein by reference.

A slotted liner, having an internal screen disposed therein, is placed within an unconsolidated subterranean zone whereby an inner annulus is formed between the screen and the slotted liner. The inner annulus is isolated from the outer annulus between the slotted liner and the wellbore wall and provides an alternative flow path for the gravel pack slurry. The gravel pack slurry flows through the inner annulus and outer annulus, between either or both the sand screen and the slotted liner and the liner and the wellbore wall by way of the slotted liner. Particulate material is thereby uniformly packed into the annuli between the screen and the slotted liner and between the slotted liner and the zone. If a bridge forms in the outer annulus, then the alternative flow path through the inner annulus allows the void to be filled beneath the bridge in the outer annulus.

The permeable pack of particulate material formed prevents the migration of formation fines and sand into the wellbore with the fluids produced from the unconsolidated zone. To prevent bridges from forming in the inner annulus, dividers may be provided that extend between the liner and screen whereby alternative flow paths in the inner annulus are formed between the screen and the slotted liner. This assembly is successful in preventing bridges from forming; however, the slotted liner requires adequate space between the screen assembly and the wellbore wall, which thereby reduces the production area of the screen assembly.

Thus, there are needs for improved methods and apparatus for completing wells in unconsolidated subterranean zones whereby the migration of formation fines and sand with produced fluids can be economically and permanently prevented while allowing the efficient production of hydrocarbons from the unconsolidated producing zone. In particular, there is a need for a frac/gravel pack apparatus which provides alternative flow paths to prevent voids from forming in the gravel pack and which does not limit or reduce the production area of the screen assembly.

The present invention overcomes the deficiencies of the prior art.

SUMMARY OF THE INVENTION

The frac/gravel pack apparatus of the present invention includes a screen assembly having a flow-control assembly disposed therein. A production packer is connected above the screen assembly to support the screen assembly within the wellbore. The screen assembly includes a base member, screens mounted on the base member, and connector subs connecting adjacent base member sections. The connector subs include apertures or ports and shiftable sleeves for closing the ports. The ports are spaced at predetermined intervals along the screen assembly. The shiftable sleeves are in the open position to open the ports during treatmnent, and the sleeves are shifted to a closed position to close the ports when the flow-control assembly is removed from the well.

The flow-control assembly includes a service assembly and a cross-over or other connection between the service assembly and the work string extending to the surface. The service assembly includes an outer tube, an internal tube, and diverters in the form of caps or shrouds. The outer tube includes externally mounted collet mechanisms and apertures or ports that align with the screen assembly ports. The internal tube is disposed within the outer tube and passes liquid returns to the surface after the returns flow through the screen assembly during gravel packing. The diverters are mounted within the outer tube and cover each port to provide a bridge barrier. Since bridging is most likely to occur at a port, the diverters mounted just inside the outer tube prevent nodes from extending radially across the inner annulus between the service assembly outer tube and internal tube and thereby prevent bridges from forming to block flow through the inner annulus. Therefore, when a bridge builds at one port, the diverter halts the radial formation of the bridge to keep an alternative flow path through the service assembly open to allow the frac fluids or gravel pack slurry to reach lower ports. Externally mounted collet mechanisms on the outer tube are designed to engage and close the shiftable sleeves as the flow-control service assembly is removed from the well after frac treatment and gravel packing are complete.

The present invention features improved methods and apparatus for fracture stimulating and gravel packing wells in unconsolidated subterranean zones, meeting the needs described above and overcoming the deficiencies of the prior art.

The improved methods comprise the steps of placing a screen assembly with a flow-control service assembly disposed therein in an unconsolidated subterranean zone; isolating the outer annulus between the screen assembly and the wellbore wall; and injecting frac fluids or a gravel pack slurry through the service assembly into the outer annulus between the screen assembly and the zone by way of axial ports located at predetermined intervals along the outer tube of the service assembly aligned with ports in the screen assembly.

The unconsolidated formation is fractured during the injection of the frac fluids into the unconsolidated producing zone with proppant being deposited in the fractures. The frac fluid is injected into the formation at a high flow rate through each of the ports, allowing a fairly uniform pressure to be applied at each port location to efficiently and uniformly fracture the zone along the entire interval from top to bottom.

During gravel packing, the particulate material in the slurry is uniformly packed into the outer annulus between the screen assembly and the borehole wall. As bridges form in the outer annulus, the inner annulus, formed between the service assembly outer tube and internal tube, provides alternative flow paths to other ports through which gravel pack slurry can flow to fill any voids formed around the screen assembly, thereby achieving a uniform gravel pack. Diverters covering the service assembly outer tube ports form a radial barrier to prevent the formation of bridges in the inner annulus thereby maintaining the alternative flow paths open through the service assembly so that particulate material can be injected into the outer annulus through lower ports to fill any remaining voids. The permeable pack of particulate material then prevents the migration of formation fines and sand into the wellbore with fluids produced from the unconsolidated zone. Once the frac treatment and gravel packing are complete, the flow-control service assembly is preferably removed from the well. As the flow-control service assembly is raised within the well bore, the outer tube closing mechanisms engage the shiftable sleeves and shift them upward to close the screen assembly ports.

The improved methods and apparatus of the present invention provide more uniform fracture pressures along the entire interval from top to bottom and prevent the formation of voids in the gravel pack, thereby producing an effective fracture and gravel pack. The apparatus of the present invention has the advantage of having a removable flow-control service assembly after frac treatment and gravel packing are complete, and therefore the flow-control service assembly does not limit the available production area within the screen assembly.

It is, therefore, a general object of the present invention to provide improved methods of fracture stimulating and gravel packing wells in unconsolidated subterranean zones. The present invention comprises a combination of features and advantages that enable it to overcome various problems of prior methods and apparatus. The characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 4A is a side view, partially in cross-section, of a shiftable sleeve mounted on a connector sub with the sleeve in the open position;

FIG. 4B is a side view, partially in cross-section, of the shiftable sleeve of FIG. 4A in the closed position;

FIG. 5 is an enlarged, isometric cross-sectional view of the shiftable sleeve of FIG. 4 mounted adjacent ports in the service assembly outer tube and connector sub;

FIG. 6 is a cross-sectional view taken perpendicular to the axis of the wellbore showing the shiftable sleeve of FIGS. 4 and 5 with axial bores and radial ports therethrough;

FIG. 7 is an enlarged schematic view of the screen assembly and service assembly of FIG. 3 showing the closing mechanism for the shiftable sleeve;

FIG. 8A is a side schematic view of the service assembly outer tube and internal tube having an internal diverter over the ports and showing the flow therethrough before a bridge is formed;

FIG. 8B is a cross-sectional view at plane 8B—8B in FIG. 8A showing a half moon-shaped embodiment of the diverter of FIG. 8A;

FIG. 9A is a side schematic view of flow through the inner annulus and diverter when no bridge has formed;

FIG. 9B is a side schematic view of flow through the alternative flow paths available around the diverter when a bridge has formed inside the diverter;

FIG. 12A is a side schematic view showing flow through the inner annulus and out an alternative port after a bridge has formed across the outer annulus and within the diverter;

FIG. 12B is a cross-sectional view at plane 12B—12B in FIG. 12A showing a half moon-shaped embodiment of the diverter of FIG. 12A showing a bridge formed within the diverter;

DETAILED DESCRIPTION OF THE PREFERRED EMBODIMENT

The present invention provides improved apparatus and methods for fracture stimulating and gravel packing an unconsolidated subterranean zone penetrated by a wellbore. The apparatus is susceptible to embodiments of different forms. The drawings described in detail herein illustrate preferred embodiments of the present invention, however the disclosure should be understood to exemplify the principles of the present invention and not limit the invention to the embodiments illustrated and described herein.

The apparatus and methods may be used in either vertical or horizontal wellbores and in either bore holes which are open-hole or cased. The term "vertical wellbore" as used herein means the portion of a wellbore in an unconsolidated subterranean producing zone to be completed which is substantially vertical or deviated from vertical in an amount up to about 30°. A highly deviated well is often considered to be in the range of 30° to 70°. The term "horizontal wellbore" as used herein means the portion of a wellbore in an unconsolidated subterranean producing zone to be completed which is substantially horizontal or at an angle from vertical in the range of from about 70° to about 90° or more.

The present invention is directed to improved methods and apparatus for achieving efficient fracturing of the entire zone or interval from top to bottom and then uniformly gravel packing that interval. The flow rate during fracturing is much higher than the flow rate during gravel packing because the frac fluid must be injected into the formation at high pressures to cause fractures in the formation. As the fluid leaks off into the formation, frac fluids must be introduced at high pressures as well as high flow-rates to continue to propagate the fractures. Preferably the frac/gravel pack intervals described herein range from approximately thirty to three hundred feet in order to achieve uniform fracturing.

Figure 2:
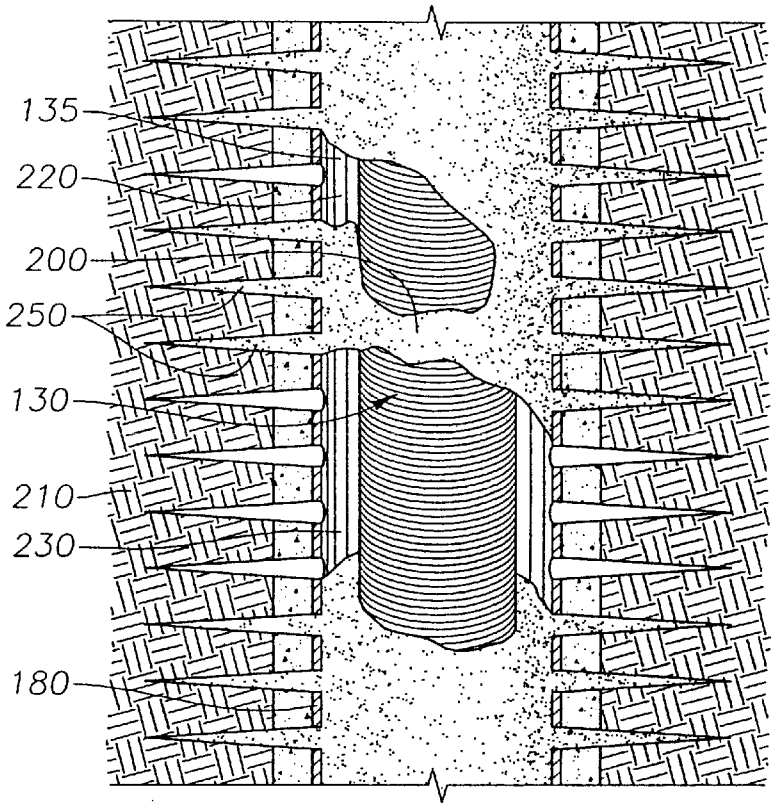
Fig. 2 Prior Art
FIG. 2 is a perspective view, partially in cross-section, illustrating the formation of bridges and voids in prior art gravel packs.
Figure 1:
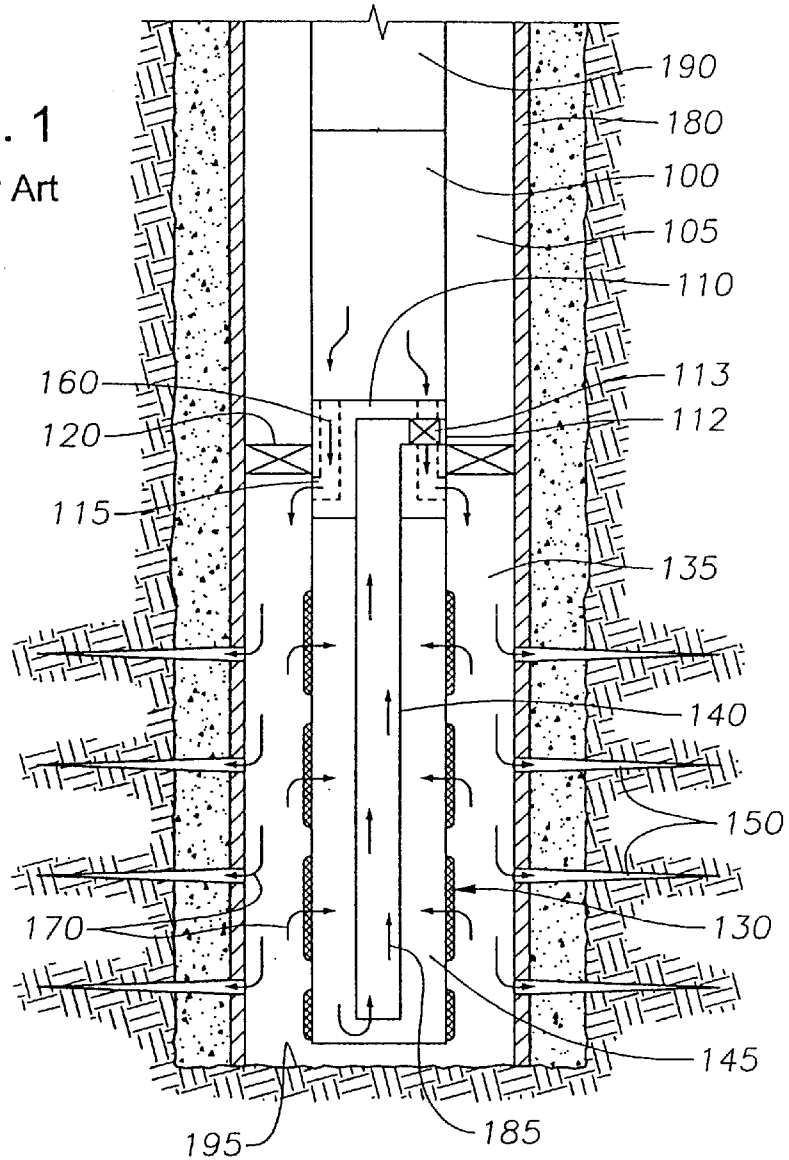
Fig. 1 Prior Art
FIG. 1 is a cross-sectional elevation view of a cased wellbore penetrating an unconsolidated subterranean producing zone and having a conventional frac/gravel pack apparatus.
Figure 3:
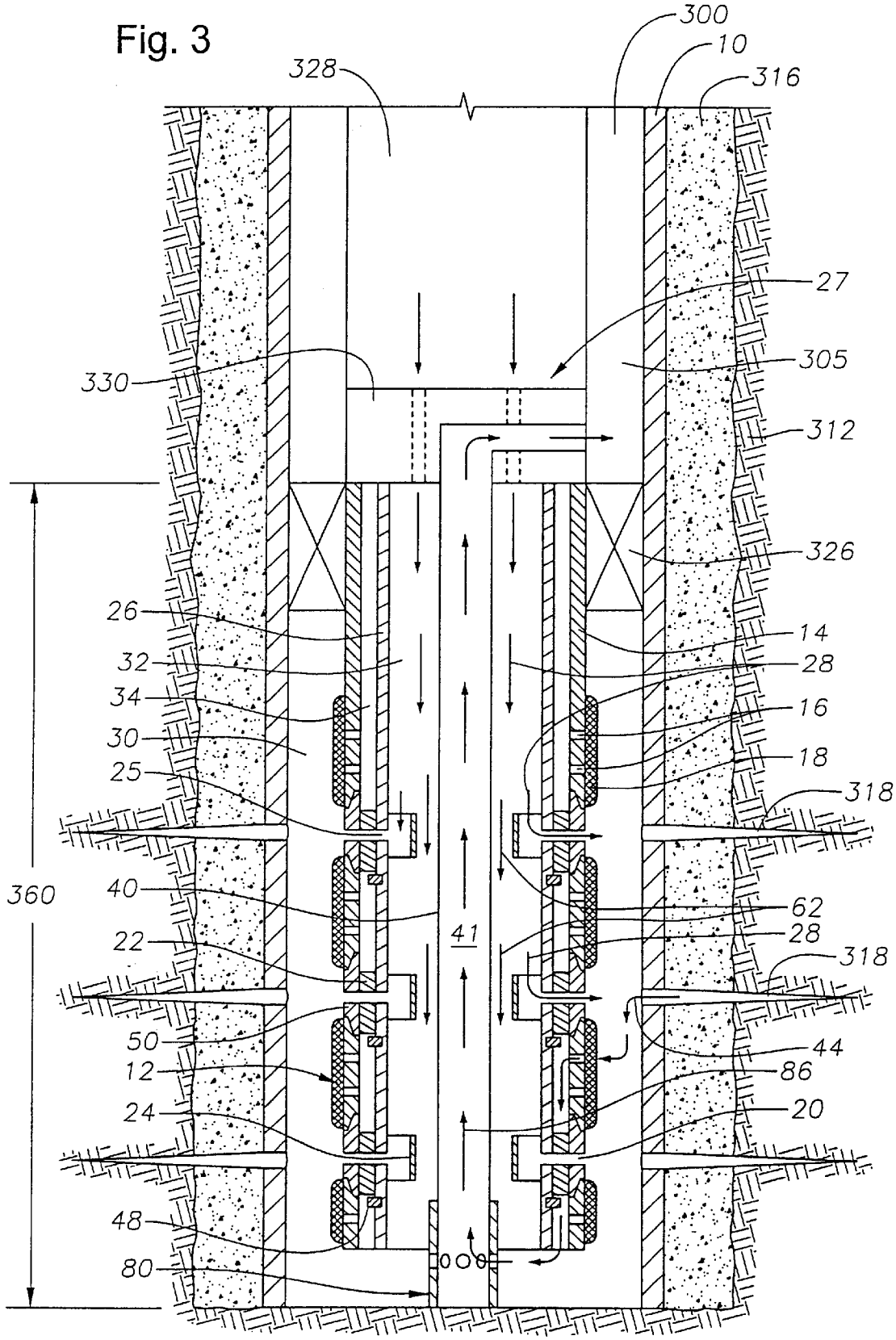
FIG. 3 is a cross-sectional elevation view of a cased wellbore penetrating an unconsolidated subterranean producing zone and having a screen assembly, with an internal flow-control service assembly including an outer tube and an internal tube.

Referring now to the drawings, and particularly to FIG. 3, a vertical wellbore 300 having casing 10 cemented therein, such as at 316, is illustrated extending into an unconsolidated subterranean zone 312. A plurality of spaced perforations 318, produced in the wellbore 300 utilizing conventional perforating gun apparatus, extend through the casing 10, cement 316 and into the unconsolidated producing zone 312.

In accordance with the apparatus and methods of the present invention, a screen assembly 12, having an internal flow-control service assembly 27 installed therein, is supported within the wellbore 300 by a production packer 326 isolating the top of the interval 360 to be treated. The production packer 326 is a conventional packer that is well known to those skilled in the art. The flow-control service assembly 27 comprises an outer tube 26, an internal tube 40, and a cross-over assembly 330. The cross-over assembly 330 supports the service assembly outer tube 26 and internal tube 40 within production packer 326 and screen assembly 12. The cross-over assembly 330 includes a three-way connector, such as for example, the connector described in U.S. patent application Ser. No. 09/399,674 filed on Sep. 21, 1999, hereby incorporated herein by reference, that connects the outer tube 26 and internal tube 40 to work string 328. The three-way connector provides fluid communication between the work string 328 and flow path 28 in outer tube 26. It also allows fluid communication between flow path 86 within internal tube 40 and the annular area 305 formed between casing 10 and work string 328.

The service assembly outer tube 26 and internal tube 40 form an inner annulus 32, the screen assembly 12 and the service assembly outer tube 26 form a medial annulus 34, and the screen assembly 12 and the casing 10 form an outer annulus 30. The screen assembly 12 and outer tube 26 have lengths such that they substantially span the length of the producing interval 360 in the wellbore 300. The internal tube 40 is suspended within the outer tube 26 and is extended to the lower end of the screen assembly 12. A return path for fluids to the surface includes the flowbore 41 of the internal tube 40, the cross-over assembly 330, and the annular area 305 formed between the work string 328 and casing 10.

Screen assembly 12 includes a base member 14, such as a pipe, having apertures 16 through its wall, which can be circular or another shape such as rectangular, and a plurality of screens 18 disposed over the apertures 16 on base member 14. Adjacent base members 14 are connected together by a connector sub 50. As shown in FIGS. 4A and 4B, each sub 50 has a plurality of exit ports 20*a* through its wall, and mounted on each sub 50 is sleeve assembly 22 having exit ports alignable with exit ports 20*a*. Sleeve 22 is reciprocably mounted to sub 50 so as to be shiftable between an open and closed position over ports 20. FIG. 4A shows port 20*b* in sleeve 22 aligned with port 20*a* in sub 50 in the open position. FIG. 4B shows port 20*a* covered by sleeve 22 in the closed position. The ports 20 are spaced along the length of interval 360 at predetermined locations to provide uniform access to the formation along interval 360. The particular fracturing and gravel pack application determines the required spacing of ports 20, but preferably subs 50 with ports 20*a* are spaced in the range of five to thirty feet apart, and preferably approximately ten feet apart.

As shown in FIGS. 4A, 4B and 5, seals 46, preferably o-rings or other seals, seal between the sleeves 22 and the inside surface of the sub 50. As best shown in FIGS. 5 and 6, sleeves 22 also include a plurality of vertical bores 42 providing a hydraulic communication across connector sub 50 through medial annulus 34 to allow fluid communication above and below each sleeve 22. As shown in FIG. 3, returns 44 will pass through screens 18, through base member apertures 16, and into medial annulus 34. The returns then flow through bores 42, as shown at 44 in FIG. 5, passing through sleeves 22 while flowing down through medial annulus 34 to the lower end of outer tube26 and up internal tube 40 as shown in FIG. 3.

Referring now to FIGS. 3 and 7, outer tube 26 has apertures or ports 25 which can be circular as illustrated in the drawings, or they can be rectangular or another shape. Ports 25 align with ports 20 such that when sleeves 22 are in the open position during frac treatment and gravel packing, there is fluid flow therethrough. A diverter 24 is disposed over each port 25 and is preferably mounted to the inside of the outer tube 26, as shown in FIG. 3, but it can alternatively be mounted to the internal tube 40, as shown in FIG. 7. Diverter 24 may be a cap or shroud and is designed to cover exit port 25 to form a barrier to gravel build up. Diverter 24 is not continuous, nor does it extend the length of base pipe 14, but instead merely extends a short distance, such as an inch or two, on each side of exit port 25 so as to maximize the flow area available in the inner annulus 32.

FIG. 8B depicts an end view taken at section 8B—8B of FIG. 8A showing one embodiment of the diverter 24 having a half-moon shape cross section forming a cover or barrier over ports 25, 20. The diverter 24 is open at the top and bottom, and as shown in FIGS. 8A and 9A, allows fluid to flow through diverter 24 along path 28 and out through ports 25, 20 or fluid can alternatively flow around diverter 24 along the flow path indicated by arrows 62.

Figure 10A:
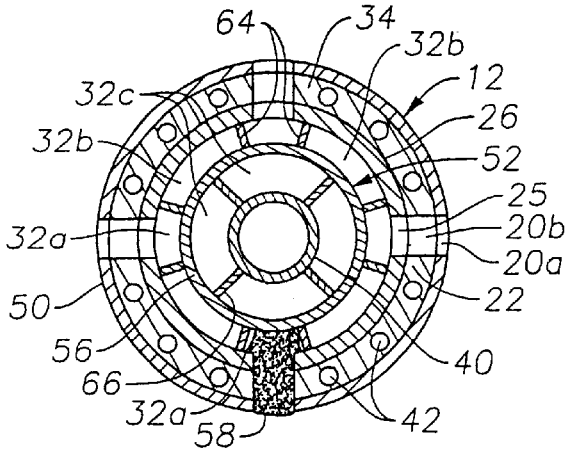
FIG. 10A is a cross-sectional view taken perpendicular to the axis of the screen assembly and service assembly showing an alternative embodiment of a diverter assembly having vanes and channelizers connected to a section of diverter pipe and positioned in the inner annulus between the service assembly outer tube and internal tube.
Figure 10B:
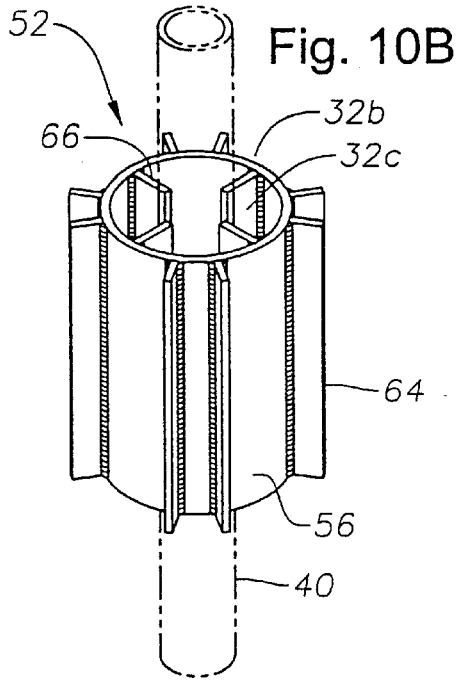
FIG. 10B is an isometric view of the diverter assembly of FIG. 10A.

Referring now to FIGS. 10A and 10B, FIG. 10A shows a cross-sectional view and FIG. 10B shows an isometric view of another diverter embodiment, diverter assembly 52. Shown in FIG. 10A are the screen assembly 12, including connector sub 50 and sleeve 22, with service assembly outer tube 26 and internal tube 40 disposed therein as shown in FIG. 3, but with diverter assembly 52 replacing diverter 24. Diverter assembly 52 is mounted internally to outer tube 26 and disposed between the outer tube 26 and internal tube 40centralizing internal tube 40 within outer tube 26. Diverter assembly 52 comprises a diverter pipe 56, outer vanes 64, and inner centralizers 66. Vanes 64 are mounted to the outside of diverter pipe 56 and extend radially along each side of ports 25,20 forming flow areas 32a around exit ports 25, 20 and flow areas 32*b* between exit ports 25,20. Centralizers 66 are mounted to the inside of diverter pipe 56 and extend radially to the internal tube 40 forming. flow areas 32*c*. Diverter pipe 56 and vanes 64 between adjacent exit ports 25, 20 prevent bridges from extending annularly to block flow by preventing nodes from forming past flow areas 32*a*. Therefore, if flow is blocked by a bridge 58 in one flow area, fluid pathways are still open through flow areas 32*a*, 32*b* and 32*c* in inner annulus 32. If the bridge 58 blocks the outer annulus 30 between the screen assembly 12 and the wellbore, then liquids may nevertheless return through the screen and flow along the medial annulus 34 between the service assembly outer tube 26 and the screen assembly 12 via the vertical bores 42 in sleeves 22.

As shown in FIG. 10B diverter pipe 56 is a lengthwise section of pipe that extends a short distance, such as one to two feet, in the axial direction above and below the center point of ports 25, 20. Vanes 64 and centralizers 66 are approximately the same axial length as the section of diverter pipe 56.

Figure 11A:
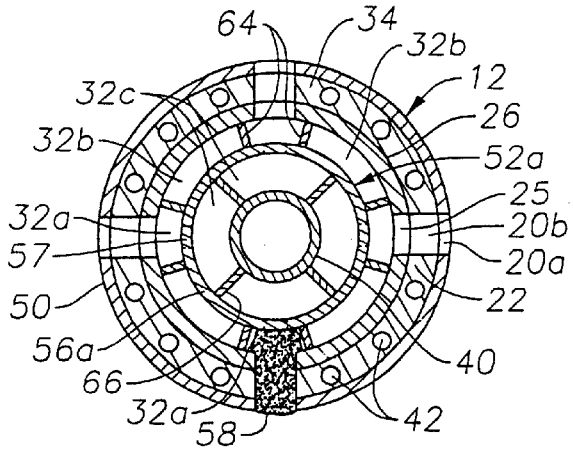
FIG. 11A is a cross-sectional view taken perpendicular to the axis of the screen assembly and service assembly showing an alternative embodiment of the diverter assembly of FIG. 10A having an axially continuous diverter pipe with apertures or ports therethrough.
Figure 11B:
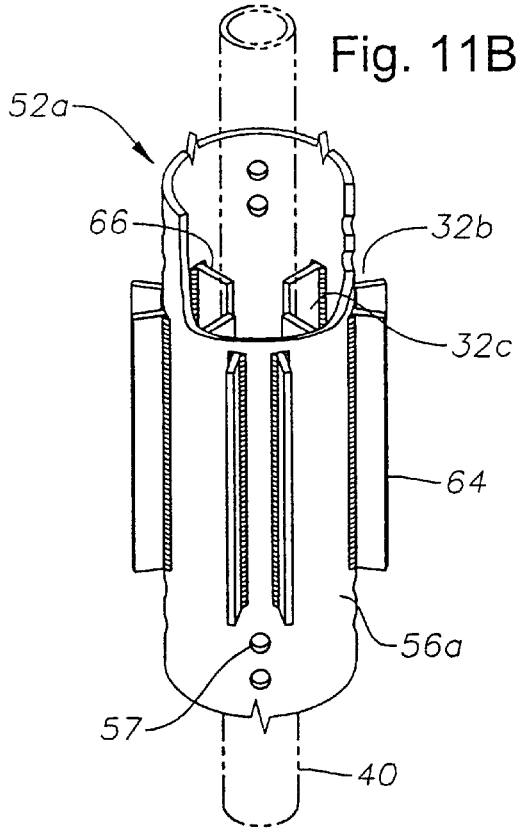
FIG. 11B is an isometric view of the diverter assembly of FIG. 11A.

FIGS. 11A and 11B depict an alternative embodiment of the diverter assembly of FIGS. 10A and 10B. FIG. 11A shows a cross-sectional view of a diverter assembly 52*a* including a diverter pipe 56*a* having apertures or holes 57 therethrough. FIG. 11B provides an isometric view of diverter assembly 52*a* showing diverter pipe 56*a* extending in the axial direction and having holes 57, shown here above and below vanes 64 around ports 25, 20. Holes 57 can be located at any point around the periphery of diverter pipe 56*a*, but should be located in the axial areas between sections of vanes and centralizers. If flow is blocked by a bridge 58 in one flow area, fluid pathways are still open through alternative flow areas 32*a*, 32*b* and 32*c*, and holes 57 allow flow communication between areas 32*c* and areas 32*a*, 32*b*. If the bridge 58 blocks the outer annulus 30 between the screen assembly 12 and the wellbore, then liquids may nevertheless return through the screen and flow along the medial annulus 34 between the service assembly outer tube 26 and the screen assembly 12 via the vertical bores 42 in sleeves 22.

Referring now to FIGS. 3 and 7, an actuator member 48 is disposed on outer tube 26 below each sleeve 22 on sub 50 along the screen assembly 12. After frac treatment and gravel packing is complete, flow-control service assembly 27 is raised within the wellbore 300 for removal. Sleeves 22 remain in the open position until flow-control service assembly 27 is removed causing actuator member 48 to engage sleeve 22 and shift it upwardly so as to close it over port 20*a* as shown in FIG. 4B whereby port 20*b* is no longer in alignment with port 20*a*. Therefore, after completing the well, the flow-control service assembly 27, with outer tube 26, internal tube 40, and cross-over 330 can be removed from the well leaving only the screen assembly 12 with base pipe 14, connector subs 50, screens 18 and sleeves 22 in the closed and locked position in the borehole. One embodiment of the actuator member 48 in the form of a weight-down collet is shown in U.S. Pat. No. 5,921,318, hereby incorporated herein by reference.

Figure 13:
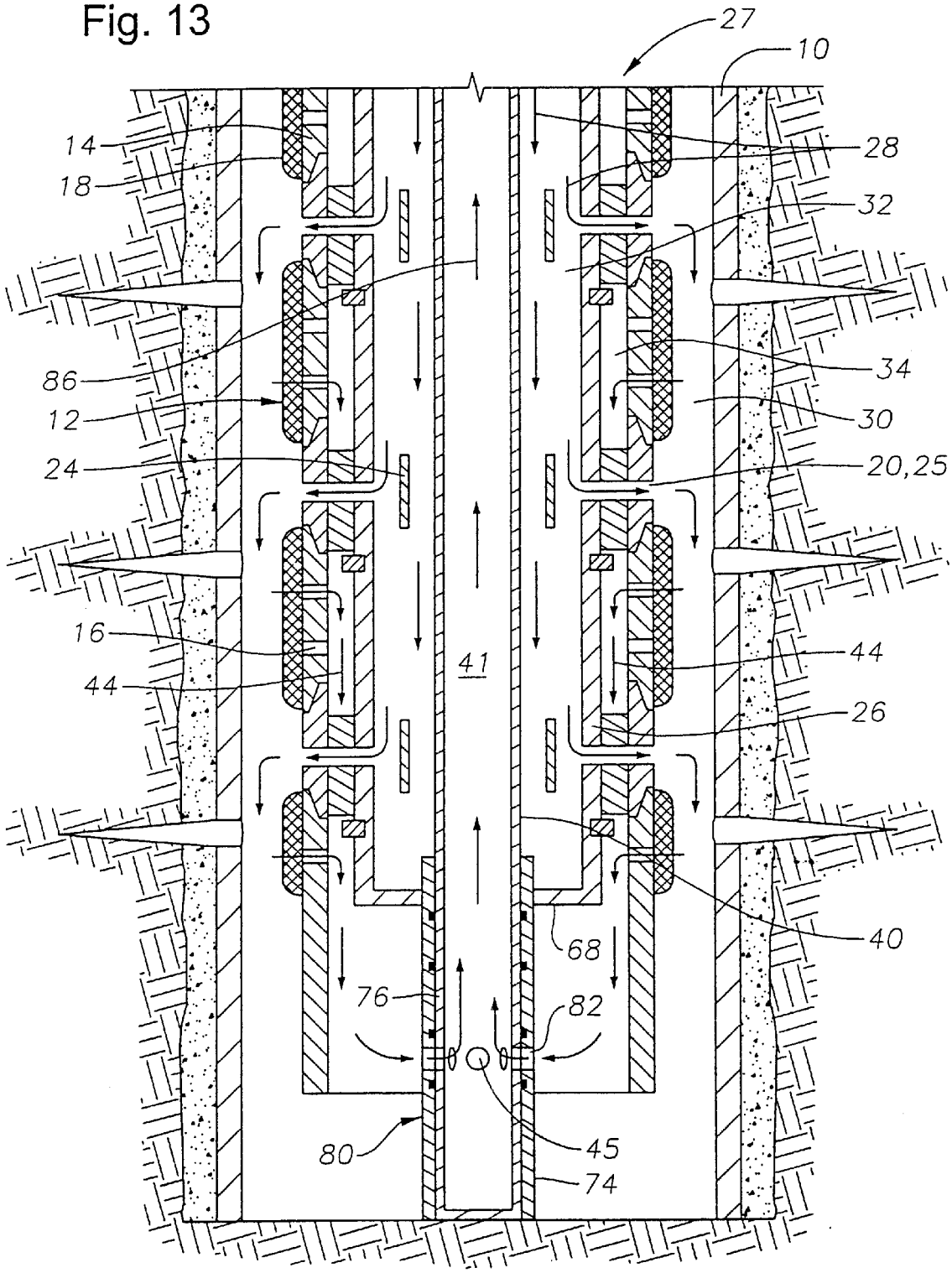
FIG. 13 is a cross-sectional elevation view of the multi-position valve assembly at the bottom of the flow-control service assembly with the multi-position valve in the "circulation" position.
Figure 14:
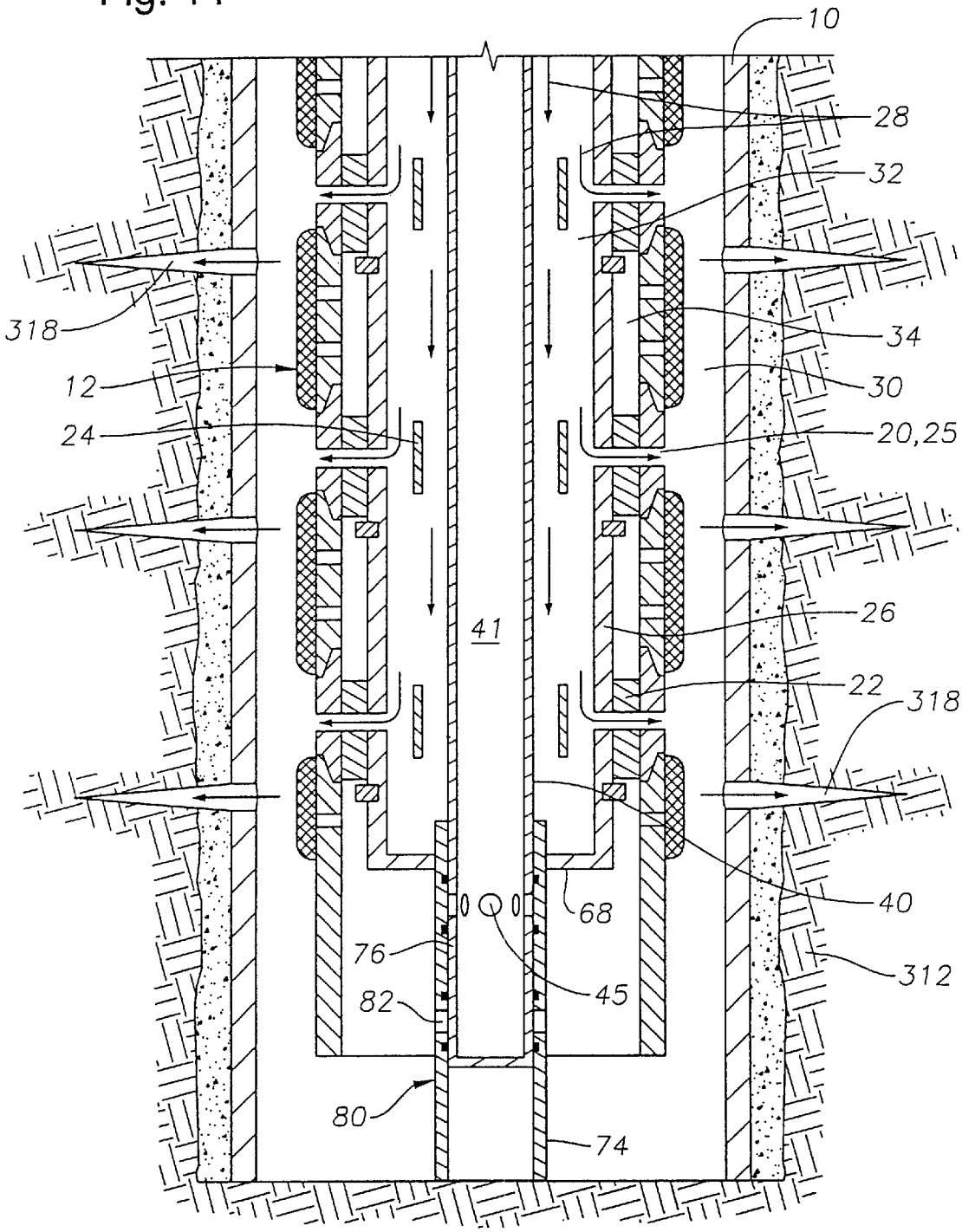
FIG. 14 is a cross-sectional elevation view of the multi-position valve assembly of FIG. 13 with the multi-position valve in the "squeeze" position.
Figure 15:
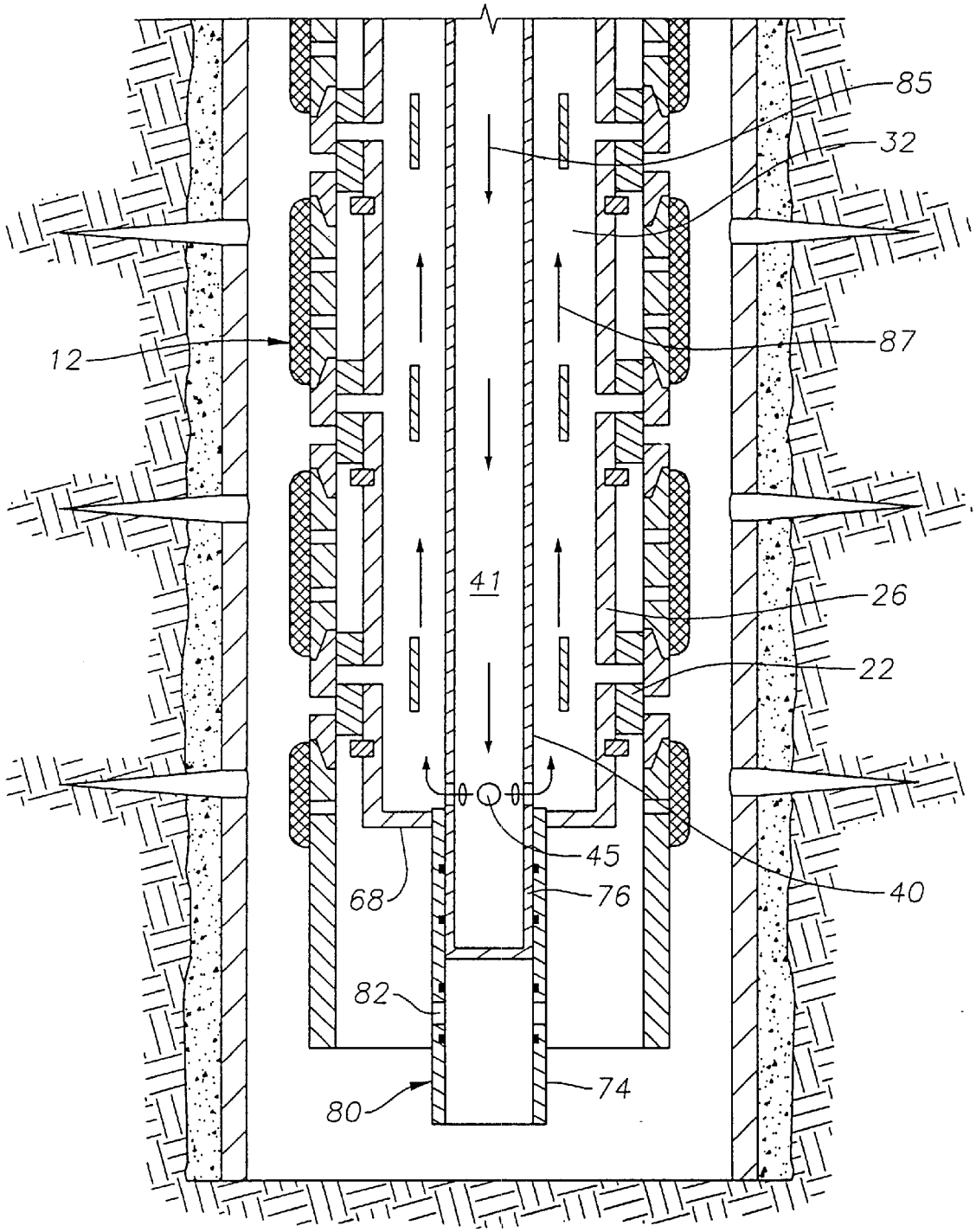
FIG. 15 is a cross-sectional elevation view of the multi-position valve assembly of FIG. 13 with the multi-position valve in the "reverse flow" position.

Referring now to FIGS. 13 through 15, the flow-control service assembly 27 includes a multi-position valve assembly 80 mounted on the lower ends of outer tube 26 and internal tube 40 which may be opened or closed to selectively allow flow through the flowbore 41 of internal tube 40. Although valve 80 is not limited to a certain embodiment and may have a number of different constructions, one embodiment of valve 80 includes a stinger assembly 76 disposed on the lower end of internal tube 40 and a receptacle assembly 74 disposed on the lower end of outer tube 26. The stinger assembly 76 is reciprocably disposed within the receptacle assembly 74 such that by raising or lowering the internal tube 40 with respect to the outer tube 26, valve 80 moves between multiple positions, including the "circulation" position shown in FIG. 13, the "squeeze" position shown in FIG. 14, or the "reverse flow" position shown in FIG. 15.

As shown in FIG. 13, with the internal tube 40 in the lowermost position with respect to outer tube 26, ports 82 in the receptacle assembly 74 align with ports 45 in the stinger assembly 76 to allow fluid to enter and flow up the flowbore 41 of internal tube 40 along path 86 to the surface. In this circulation position, valve 80 allows flow from medial annulus 34 and outer annulus 30 into flowbore 41 of internal tube 40. As shown in FIG. 14, with the internal tube 40 in its intermediate or squeeze position, ports 45 in the stinger assembly 76 are out of alignment with ports 82 in the receptacle assembly 74. Therefore, because the lower end of stinger assembly 76 is closed off and ports 45 are closed off by receptacle assembly 74, flow is prevented from entering and flowing up flowbore 41 of internal tube 40. Thus, there is no flow from annuli 32, 34, or 30 into internal tube 40. As shown in FIG. 15, with the internal tube 40 in its upper or reverse flow position, ports 45 in stinger assembly 76 have moved above receptacle assembly 74 and are exposed to inner annulus 32. In this position, fluid may flow from the surface through the flowbore 41 of internal tube 40 and through ports 45 into inner annulus 32 or fluid may flow through inner annulus 32 into the flowbore 41 of internal tube 40 and up to the surface. Thus, there is flow between inner annulus 32 and flowbore 41 but not between annuli 34 or 30 and flowbore 41.

Referring again to FIG. 3, in operulion, the screen assembly 12 and production packer 326 are installed in the well bore with the screen assembly 12 having a length allowing it to bridge or extend the length of the production zone interval 360 to be treated. The flow-control service assembly 27 with cross-over assembly 330, outer tube 26, internal tube 40, and valve assembly 80 are installed on work string 328 in the wellbore 300. Inner annulus 32, medial annulus 34 and outer annulus 30 are thus formed across interval 360. Upon setting the packer 326 in the casing 10, the outer annulus 30 between the screen assembly 12 and the casing 10 is isolated.

Referring now to FIGS. 3 and 13, in the frac treatment, a frac fluid is injected down work string 328 and through cross-over 330 into inner.annulus 32 between internal tube 40 and outer tube 26 along primary flow path 28. The frac fluid passes downwardly through inner annulus 32 and through aligned and open ports 20, 25 into outer annulus 30. Initially outer annulus 30 is filled with well fluids or preferably brine, for example, which is displaced by the incoming frac fluids and returned to the surface. The multi-position valve 80 is initially in the circulation position, allowing the well fluids or brine to pass through screens 18 and slots 16 in base members 14 and down medial annulus 34 between the screen assembly 12 and the outer tube 26, passing through axial ports 42 in sleeves 22 as shown in FIG. 5. Ports 45 in the stinger assembly 76 on wash pipe 40 are aligned with open ports 82 in the receptacle assembly 74 on valve assembly 80 to allow flow upwardly through flowbore 41 along path 86.

Referring now to FIGS. 3 and 14, once the well fluid or brine is fully displaced, the valve assembly 80 is moved to the "squeeze" position as shown in FIG. 14. In the squeeze position, internal tube 40 is raised with respect to outer tube 26 so that ports 45 in stinger assembly 76 are out of alignment with ports 82 in receptacle assembly 74. The bottom of internal tube 40 is closed off and because ports 45 are covered by the wall of receptacle assembly 74, fluid is prevented from entering internal tube 40 and flowing to the surface. Thus, the frac fluid is pumped at a high flow rate and under high pressures down work string 328 and into outer annulus 30. Because the frac fluid is prevented from flowing to the surface through internal tube 40, it is forced through perforations 318 and into the formation 312. By injecting frac fluid at high flow rates and pressure through perforations 318, the rock in the formation is fractured creating open void spaces in the formation until equilibrium is reached, i.e., the amount of frac fluid introduced into the formation equals the amount of fluid leaking off into the formation and the fractures stop propagating. Alternatively, if a leakage equilibrium is not achieved, a tip screen out approach may be used where proppant is -injected into the fracture tips to prevent further fracture propagation. Then proppant is added to the frac fluid and injected into perforations 318 to maintain the voids in an open position for production.

The objective of the frac treatment is to uniformly fracture the entire interval 360 from top to bottom, and the methods and apparatus of the present invention overcome limitations of the prior art with respect to uniform fracturing. Specifically, ports 20, 25 take the place of and eliminate the need for a conventional cross-over that introduces fluids into the outer annulus 30 only at the top of the interval 360. Ports 20, 25 essentially act as multiple cross-over points located at predetermined spaced locations along the entire length of interval 360 such that the frac fluids can exit through any one of the ports 20, 25 as it flows through inner annulus 32 along flow path 28. By having multiple exit points, substantially the same pressure may be applied along the formation face at the same time through each of the ports 20, 25 versus the significant difference in pressure applied along the face at the upper and lower extents of the formation when the fluid is introduced only at the top of the interval 360 using a conventional cross-over. Therefore, the methods and apparatus of the present invention provide a more effective and uniform fracture over the entire interval 360.

Referring again to FIGS. 3 and 13, when the frac treatment is complete, the well bore 300 is then gravel packed or the gravel pack may take place simultaneously with the frac treatment. In gravel packing, the internal tube 40 is placed in the circulation position shown in FIG. 13. The gravel pack slurry of carrier fluid mixed with particulate material, typically graded sand commonly referred to as gravel, is injected down the same flow path described for the initial frac fluid. The slurry is pumped down work string 328, through cross-over 330 and along path 28 in inner annulus 32. The slurry passes around and through diverters 24 out ports 20, 25 because the inner annulus 32 is sealed off by the bottom 68 of the service assembly.

Some of the carrier fluid in the slurry leaks off through the perforations 318 into the unconsolidated zone 312 of interval 360 while the remainder, i.e, the returns 44, flow back through screen assembly 12 into medial annulus 34 and down through vertical bores 42 in sleeves 22 to the lower end of the internal tube 40. As shown in FIG. 13, when returns 44 reach the bottom of internal tube 40, they flow through open ports 82 in the receptacle assembly 74 aligned with open ports 45 in the stinger assembly 76 of valve assembly 80 allowing flow to continue upwardly through flowbore 41 along path 86 to the surface.

As the flow of the slurry slows and the carrier fluid leaks off, the gravel or solids, settles out and separates from the carrier fluid. The gravel begins to pack as it becomes dehydrated due to the leak off of the fluids. Typically the gravel may initially accumulate at the bottom of the wellbore 300 and then upwardly in the outer annulus 30. With the multiple exit ports 20, 25, gravel packing may occur along the entire interval 360 simultaneously.

The building of nodes is one of the primary methods of gravel packing the borehole. However, if the nodes form prematurely and build bridges across the outer annulus 30, voids can be formed in the gravel pack that are undesirable. Thus, if a node does begin to build prematurely, it is important that an alternative flow path past the node be provided such that any void beneath a bridge can be gravel packed from underneath the bridge so as to fill the void and achieve a uniform gravel pack throughout the annulus.

Diverters 24 are designed to prevent bridges from forming across and around inner annulus 32 inside of service assembly outer tube 26. As shown in FIG. 12A, when the slurry passes through ports 20, 25, gravel will be deposited in and around perforations 318, into annulus 30 and back to ports 20, 25, thereby promoting gravel buildup and the formation of a node 58 around port 20. As shown in FIG. 12A and 9B, when node 58 grows and engages diverter 24 at 60, the radial growth of node 58 is stopped. FIG. 12B shows a cross-sectional view taken at 12B-12B of the diverter of FIG. 12A with node 58 formed. Therefore, when a bridge 58 is created and the gravel extends into diverter 24 at 60, the diverter 24 stops the gravel from moving radially and annularly between the service assembly outer tube 26 and internal tube 40. The diverter 24, therefore, is designed to provide a barrier and stop the formation of a bridge that would block flow through the outer tube 26.

As shown in FIGS. 3, 9A, and 9B, the diverters 24 and ports 20, 25 provide a plurality of alternative flow paths to the gravel slurry flowing between the internal tube 40 and outer tube 26. The slurry has two possible flow paths as it moves through inner annulus 32. It can either pass into diverter 24 along flow path 28 and through exit ports 25, 20 into outer annulus 30, or it can bypass around the outside of diverter 24 along flow path 62 and continue downwardly through outer tube 26 to another set of aligned ports 25, 20. Once a bridge 58 is created, then flow will just be forced down another path 62. Therefore, as nodes build, they may form bridges across outer annulus 30 at certain perforations 318. However, as shown in FIGS. 12A and 9B, due to the plurality of alternative flow paths 62 through inner annulus 32, if one of the exit ports 20, 25 becomes blocked by a bridge 58 reaching diverter 24 at 60, alternative flow paths 62 allow the gravel slurry to bypass diverter 24 and flow to another exit port 20, 25 located at a point beneath the bridge so as to fill the void with gravel. Thus, even if a bridge forms in outer annulus 30, flow paths 62 provide access to ports 20, 25 below the bridge to fill and complete the gravel pack in outer annulus 30. Thus, the present invention achieves the objective of providing a continuous gravel pack throughout outer annulus 30 such that and there are no voids in the gravel pack upon completion of the operation.

Referring again to FIGS. 3 and 15, after the particulate material has been packed in outer annulus 30 around screen assembly 12, any gravel and/or proppant in inner annulus 32 will be removed. Such gravel/proppant can cause equipment abrasion problems or cause tools to get stuck downhole, preventing them from being removed from the wellbore. Prior to reverse circulating the inner annulus 32, it is necessary to close ports 20, 25, otherwise the circulation fluids would flow into outer annulus 30. Thus, the flow-control service assembly 27 is raised a sufficient distance to close ports 20. In raising outer tube 26, the actuator member 48, which is biased outwardly, engages a mating profile on the internal surface of sleeve 22 and moves it upwardly on the connector sub 50 of screen assembly 12. As actuator members 48 pull sleeves 22 upward, another shoulder inside sleeve 22 contacts actuator member 48 and forces it to retract and release sleeve 22 once sleeve 22 is in the closed position. When the sleeve reaches the closed position, it latches into place over ports 20, 25. Although the latching mechanism is capable of a number of different constructions, one embodiment comprises a spring biased latching member that expands and engages an internal profile in sleeve 22 thereby latching sleeve 22 in the closed position to keep ports 20, 25 closed. As shown in FIG. 4B, seals 46 seal between sleeve 22 and sub 50 around ports 20 when sleeve 22 is in the closed position.

Referring now to FIG. 15, to reverse circulate inner annulus 32 to remove any gravel, the valve assembly 80 is moved to the reverse flow position. Internal tube 40 is raised within outer tube 26 to bring stinger assembly ports 45 to a position above the closed-off bottom 68 of service assembly 26. Fluids free of solids can now be reverse circulated down work string 328, down wash pipe 40 along path 85 and out ports 45 to push any gravel that might have deposited in annulus 32 up to the surface with the fluids along path 87. The removal of the gravel and proppant allows the retrieval of the flow-control service assembly 27.

It is preferable to maximize the aggregate flow area through screen assembly 12 so as to maximize the flow of well fluids produced through screen assembly 12 from the production zone. Because the service assembly outer tube 26 and internal tube 40 are removable from the wellbore after gravel packing is complete, the flow area for production can be maximized and the flow-control service assembly 27 with outer tube 26 and internal tube 40 can be used again rather than becoming part of the permanent downhole assembly.

Thus, the present invention achieves the objective of uniform gravel packing using an apparatus that is removable from the wellbore upon completion so as not to limit the size of the production area.

After the gravel pack is complete in wellbore 300 as described above, the well is returned to production, and the pack of particulate material filters out and prevents the migration of formation fines and sand with fluids produced into the wellbore from the unconsolidated subterranean zone 312.

The particulate material utilized in accordance with the present invention is preferably graded sand but may be a man-made material having a similar mesh size. The particulate material is sized based on a knowledge of the size of the formation fines and sand in the unconsolidated zone to prevent the formation fines and sand from passing through the gravel pack, i.e., the formed permeable sand pack. The graded sand generally has a particle size in the range of from about 10 to about 70 mesh, U.S. Sieve Series. Preferred sand particle size distribution ranges are one or more of 10–20 mesh, 20–40 mesh, 40–60 mesh or 50–70 mesh, depending on the particle size and distribution of the formation fines and sand to be screened out by the graded sand.

The particulate material carrier fluid can be any of the various viscous carrier liquids or fracturing fluids utilized heretofore including gelled water, oil base liquids, foams or emulsions or it may be a non-viscous fluid such as water, brine or an oil based liquid. The foams utilized have generally been comprised of water based liquids containing one or more foaming agents foamed with a gas such as nitrogen. The emulsions have been formed with two or more immiscible liquids. A particularly useful emulsion is comprised of a water-based liquid and a liquefied normally gaseous fluid such as carbon dioxide. Upon pressure release, the liquefied gaseous fluid vaporizes and rapidly flows out of the formation. The liquid utilized is preferably a non-viscous or low viscosity fluid that can also be used to fracture the unconsolidated subterranean zone if desired.

The most common carrier liquid/fracturing fluid utilized heretofore, which is also preferred for use in accordance with this invention, is comprised of an aqueous liquid such as fresh water or salt water combined with a gelling agent for increasing the viscosity of the liquid. The increased viscosity reduces fluid loss and allows the carrier liquid to transport significant concentrations of particulate material into the subterranean zone to be completed. A variety of gelling agents are described in U.S. patent application Ser. No. 09/361,714 filed on Jul. 27, 1999, hereby incorporated herein by reference, which is a continuation-in-part of application Ser. No. 09/084,906 filed on May 26, 1998, hereby incorporated herein by reference, which is a continuation-in-part of application Ser. No. 08/951,936 filed on Oct. 16, 1997, now U.S. Pat. No. 6,003,600, hereby incorporated herein by reference. See also European patent application EP 0 909 874 A2 published Apr. 21, 1999 and European patent application EP 0 909 875 A2published Apr. 21, 1999, both hereby incorporated herein by reference.

Thus, it can be seen that the methods and apparatus of the present invention provide effective means for fracturing and uniformly gravel packing wells in unconsolidated subterranean zones. The present invention can achieve more uniform fracturing along the entire interval from top to bottom by injecting frac fluids into the formation at fairly uniform pressures through a plurality of exit ports extending along the length of the service assembly. These exit ports also provide alternative flow paths to inject gravel along the screen assembly, especially to fill voids beneath bridges that form in the gravel pack. Diverters mounted internally of these ports form a barrier to prevent the gravel from bridging across the entire inner annulus between the service assembly outer tube and internal tube, thus allowing flow to bypass the diverter and exit through another open port below. The present invention is especially beneficial for use in high production rate wells because the apparatus of the present invention is disposed within the screen assembly, so it does not limit the internal diameter of the screen assembly, i.e. the production area. The apparatus of the present invention is also removable from the wellbore after frac treatment and gravel packing are complete thereby maximizing the well production capacity of the screen assembly and reducing costs by not becoming part of the permanent downhole assembly.

While preferred embodiments of this invention have been shown and described, modifications thereof can be made by one skilled in the art without departing from the spirit or teaching of this invention. In particular, various embodiments of the present invention provide a number of different constructions. The embodiments described herein are exemplary only and are not limiting. Many variations of the system in which the apparatus may be used are also possible and within the scope of the invention. Namely, the present invention may be used in conjunction with any type of screen assembly such that the particular configuration of screen assembly illustrated and described herein is meant merely to illustrate the function of the present invention as an alternative path or flow diversion apparatus. Accordingly, the scope of protection is not limited to the embodiments described herein, but only by the claims that follow, the scope of which shall include all equivalents of the subject matter of the claims.

What is claimed is:

1. A method of flowing fluids into an unconsolidated subterranean zone penetrated by a wellbore comprising:

disposing a length of screen assembly in the wellbore adjacent the unconsolidated subterranean zone, the screen assembly including a plurality of screens;

disposing apertures in the screen assembly along said length at predetermined intervals;

disposing a flow-control member within said screen assembly to direct fluid flow through the apertures and not through the screens;

passing frac fluids through the flow-control member, through the apertures and into the unconsolidated subterranean zone.

2. The method of claim 1, further including applying a substantially uniform fluid pressure through the apertures along the length of the screen assembly.

3. The method of claim 1 further including creating fractures uniformly along the unconsolidated subterranean zone from top to bottom.

4. The method of claim 1 wherein the flow-control member includes inner and outer members forming a flow-bore within the inner member, an annular flow area between the inner and outer members, and ports in the outer member communicating with the apertures in the screen assembly, the outer member forming an annular passageway with the screen assembly.

5. The method of claim 4 further including flowing fluid into the annular flow area, through the ports and apertures, and into the formation.

6. The method of claim 5 further including preventing the extent of radial build up of sand at the ports and providing an alternative flow route around the sand build up in the outer member.

7. The method of claim 4 further including flowing fluids through the screens, into the annular passageway and into the flowbore of the inner member.

8. The method of claim 4 further including providing a valve member controlling flow through the inner member.

9. The method of claim 4 wherein the flow-control member includes internal alternative flow paths allowing particulate material to flow through or around the ports.

10. The method of claim 1 further including providing closure members to close the apertures, the closure members having flow passageways allowing flow between the flow-control member and screen assembly.

11. The method of claim 1 further including closing the apertures.

12. The method of claim 1 further including moving the flow-control member to close the apertures.

13. The method of claim 1 further including removing the flow-control member from the wellbore.

14. An improved method of completing an unconsolidated subterranean zone penetrated by a wellbore having an upper and lower end comprising the steps of:

placing in the lower end of the wellbore a screen assembly having open ports and an outer tubular member disposed therein having open ports that align with said screen assembly ports whereby a first annulus is formed between the screen assembly and the outer tubular member and a second annulus is formed between the screen assembly and the lower end of said wellbore;

hanging an internal tubular member within said outer tubular member whereby a third annulus is formed between the internal tubular member and the outer tubular member;

isolating said second annulus between the lower wellbore end and the upper wellbore end in the zone;

injecting particulate material into said third annulus, through said aligned open ports, and into said second annulus;

creating fractures in said subterranean zone while injecting the particulate material into the second annulus;

depositing particulate material in said fractures;

uniformly packing the particulate material along the screen assembly in said second annulus;

closing off the internal tubular member to fluids entering from within the well;

injecting particulate-free liquid through said internal tubular member into said third annulus and flowing said liquid up to the surface through said third annulus;

closing said screen assembly ports;

removing the outer tubular member and the internal tubular member from the wellbore; and placing the unconsolidated subterranean zone on production.

* * * * *